United States Patent [19]

Mahon

[11] Patent Number: 4,678,930

[45] Date of Patent: Jul. 7, 1987

[54] MICROWAVE OVEN TIMER

[75] Inventor: Joseph J. Mahon, Libertyville, Ill.

[73] Assignee: Eaton Corporation, Cleveland, Ohio

[21] Appl. No.: 826,434

[22] Filed: Feb. 5, 1986

[51] Int. Cl.[4] ..... H01H 43/00

[52] U.S. Cl. ..... 307/141; 200/38 R; 200/38 FA; 200/38 B

[58] Field of Search ..... 200/38 R, 38 A, 38 FA, 200/38 B, 38 BA, 38 C, 38 CA, 35 R; 219/10.55 B, 10.55 C; 307/139, 140, 141, 141.4, 141.8; 340/309.15, 309.6

[56] References Cited

U.S. PATENT DOCUMENTS

| | | | |
|---|---|---|---|
| 3,417,211 | 12/1968 | Wiser | 200/38 R |
| 3,566,051 | 2/1971 | Hulterstrum et al. | 200/38 C |
| 3,596,015 | 7/1971 | Jullien-Davin | 200/38 R |
| 4,177,370 | 12/1979 | Otani | 219/10.55 B |
| 4,206,337 | 6/1980 | Marquis | 219/10.55 B |
| 4,468,600 | 8/1984 | Barthel et al. | 200/38 B X |
| 4,523,062 | 6/1985 | Mahon | 200/38 R X |
| 4,551,590 | 11/1985 | Mahon | 200/38 R |
| 4,560,846 | 12/1985 | Klopp et al. | 200/38 R |
| 4,577,179 | 3/1986 | Chambers et al. | 200/38 R X |

*Primary Examiner*—J. R. Scott

*Attorney, Agent, or Firm*—D. A. Rowe; R. A. Johnston

[57] ABSTRACT

A programmer timer for an appliance, such as microwave cooking oven, having a magnetron power switch positioned by a control selectively moved to one of three power level settings by user rotation of the single rotary knob to a selected position on one of three separate cooking program interval range scales on the dial. Selection of a knob position on the first scale provides a 100% magnetron duty cycle, or full "ON", cooking mode for the desired cooking interval, selection of a knob position on the second scale provides a first predetermined fractional duty cycle for "MEDIUM" power level magnetron operation for the desired cooking interval; and, selection of a knob position on the third scale provides a second predetermined fractional duty cycle for "LOW" or "DEFROST" power level magnetron operation for the desired cooking program interval. A single timing motor drives a cam advance mechanism for effecting time-out of the selected program interval for the three power levels of operation.

22 Claims, 8 Drawing Figures

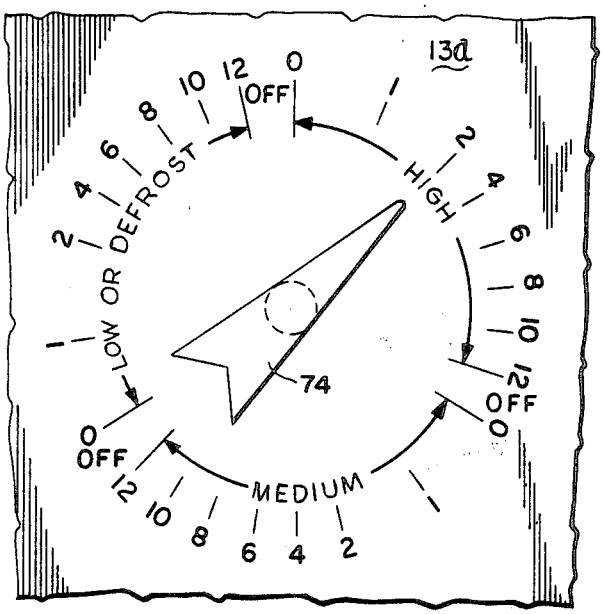
Fig. 4
Fig. 5
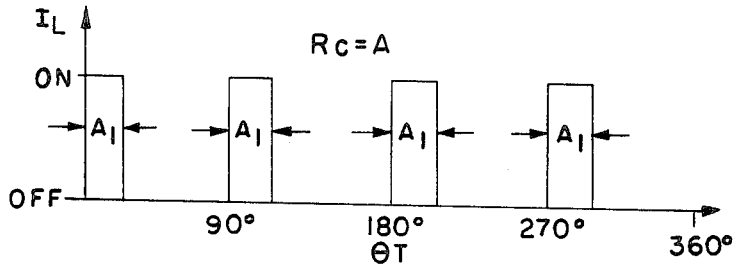
Fig. 6
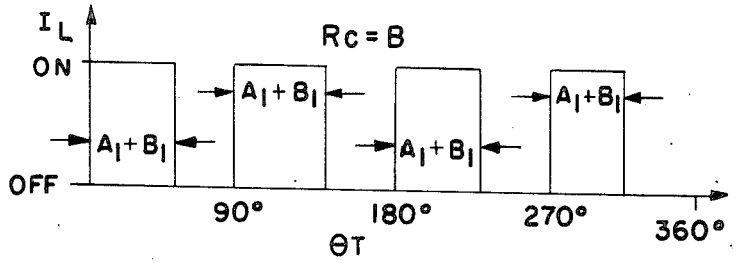
Fig. 7
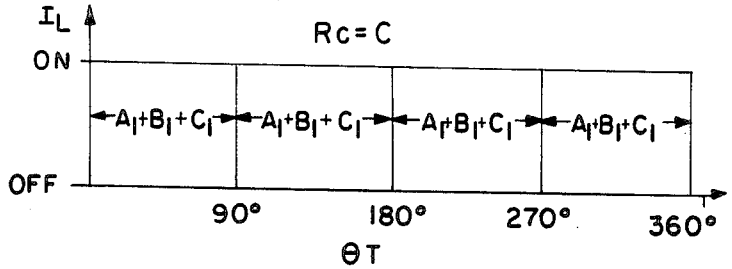

MICROWAVE OVEN TIMER

BACKGROUND OF THE INVENTION

The present invention relates to electrical timing devices for controlling the mode and duration of operation of a domestic appliance such as a clothes dryer or microwave cooking oven. Appliances of this type for household use commonly employ a plurality of electrical switches sequentially operated by a rotating cam drum or similar mechanism. Typically the cam drum is rotated in timed advance for operating the switches by a suitable speed reducer means commonly driven by a small sub-fractional horse power synchronous timing motor, and, cam followers actuate the various switches.

Such devices are known as electromechanical timers and are employed in household appliances produced commercially in high volume production as a cost effective and competitive alternative to a more sophisticated programmable all-electronic switching mechanism in view of the cost of the solid state switching devices and microprocessors required to provide the programming for the various selected modes of operation and time durations. All-electronic programmer timers require solid state switching devices capable of handling the current load required for the appliance load function as for example the magnetron in a microwave cooking oven. Solid state switching devices capable of handling the appliance load current are prohibitively expensive for commercial volume production of household appliances. Thus, although all-electronic programmer timers may provide sophisticated combinations of control functions by virtue of the program storage capability of the microprocessor memory, such all-electronic systems are expensive to produce. In addition, all-electronic programmer timers, although capable of providing the user with a wide variety of control functions, often present a confusing array of user inputs and are thus more difficult to operate by users unfamiliar with digitally encoded control inputs.

Thus it has been desired to improve the program control capability of electro-mechanical programmers. In designing electro-mechanical programmer timers for appliances such as microwave cooking ovens, it has been desired to provide the user with a selection of power levels of magnetron operation in addition to the selection of the duration of the cooking program interval. Heretofore, microwave cooking ovens have provided thereon separate selector switches for the user to select the power level of operation and for the selection of the duration of program interval. For example a rotary dial knob has been provided for setting the program time interval and a separate push button or slide type switch has been provided for the selection of the mode or power level of operation.

Known mechanisms for providing plural modes or power levels of magnetron operation in a microwave oven have employed separate cam drums and timing motors for advancing the cams at different rates for providing fractional duty cycle pulsing of the magnetron to thereby provide less than full "ON" operation of the magnetron during the desired program interval. These types of programmer timers have been found to be costly to manufacture and have often resulted in improper cooking where the user sets the program interval timer for the desired time duration and inadvertently fails to select the correct power level of operation. Therefore it has long been desired to find a way or means of providing a microwave cooking oven having an electromechanical programmer timer low in manufacturing cost which provides multiple power level operation and to provide such an oven with simplified controls for user operation.

SUMMARY OF THE INVENTION

The present invention provides an electromechanical programmer timer for an appliance, such as a microwave cooking oven, and provides simplified controls for user selection of the program interval for cooking and the mode of operation or magnetron power level.

The programmer timer of the present invention employs a single control input knob which is rotated by the user to a selected range scale for selection of the desired interval, there being provided three separate range scales, one for each of a HIGH, MEDIUM and LOW, or DEFROST mode of operation of the magnetron. Thus, the user may select both the power level or mode of operation and the desired program interval of operation by rotating a single control input knob to a selected time position on the scale provided for the desired mode of operation. The programmer timer of the present invention employs an electrical switch series connected with the magnetron and actuated by followers responding to cam drums which are driven at different rates of advance by a speed reducer driven by a single timing motor.

The series switch has one moveable contact arm thereof positioned by a main interval cam attached to the control knob. Rotation of the control knob to the desired combined power level-interval range scale positions the contact arm for the desired duty cycle for magnetron operation. A second contact arm for the switch is cycled by a second or sub-interval cam between a position making, and a position breaking, the circuit with the pre-positioned first contact. The main interval cam is advanced for time-out by pawl-driven ratchet wheel attached to the main interval cam, the pawl being driven by an eccentric shaft extending from the speed reducer. The sub-interval cam is cycled by a separate pinion gear from the speed reducer driving a ring gear attached to the main interval cam; and, the ring gear preferably has its internal teeth journalled directly on a stationary hub on the speed reducer.

User rotation of the main interval cam to the selected time interval position on one of the power level scales prepositions one of the switch contacts to control the break point of the switch during rotation of the sub-interval cam against the second contact thereby producing the desired fraction of magnetron "ON" time during the rotation of the sub-interval cam.

The present invention thus provides a low cost simplified electromechancal programmer timer for appliances, such as microwave cooking ovens, which enables the user to select both the desired mode of operation or power level and program interval by rotating a single control knob to the desired position. The programmer timer of the present invention provides the multiple function selection with a single control input and yet employs a timing mechanism driven by only a single motor.

BRIEF DESCRIPTION OF THE DRAWINGS

FIG. 5 is a timing diagram of the mechanism of FIG. 2 in the LOW or DEFROST mode;

FIG. 6 is a view similar to FIG. 5 for the mechanism of FIG. 2 in the MEDIUM mode of operation;

FIG. 7 is a view similar to FIG. 5 showing the present invention operating in the 100% duty cycle mode; and FIG. 8 is a schematic similar to FIG. 1 showing an alternate embodiment for a microwave oven having the timing motor shut-off switch combined with the magnetron power switch.

DETAILED DESCRIPTION

Figure 1:
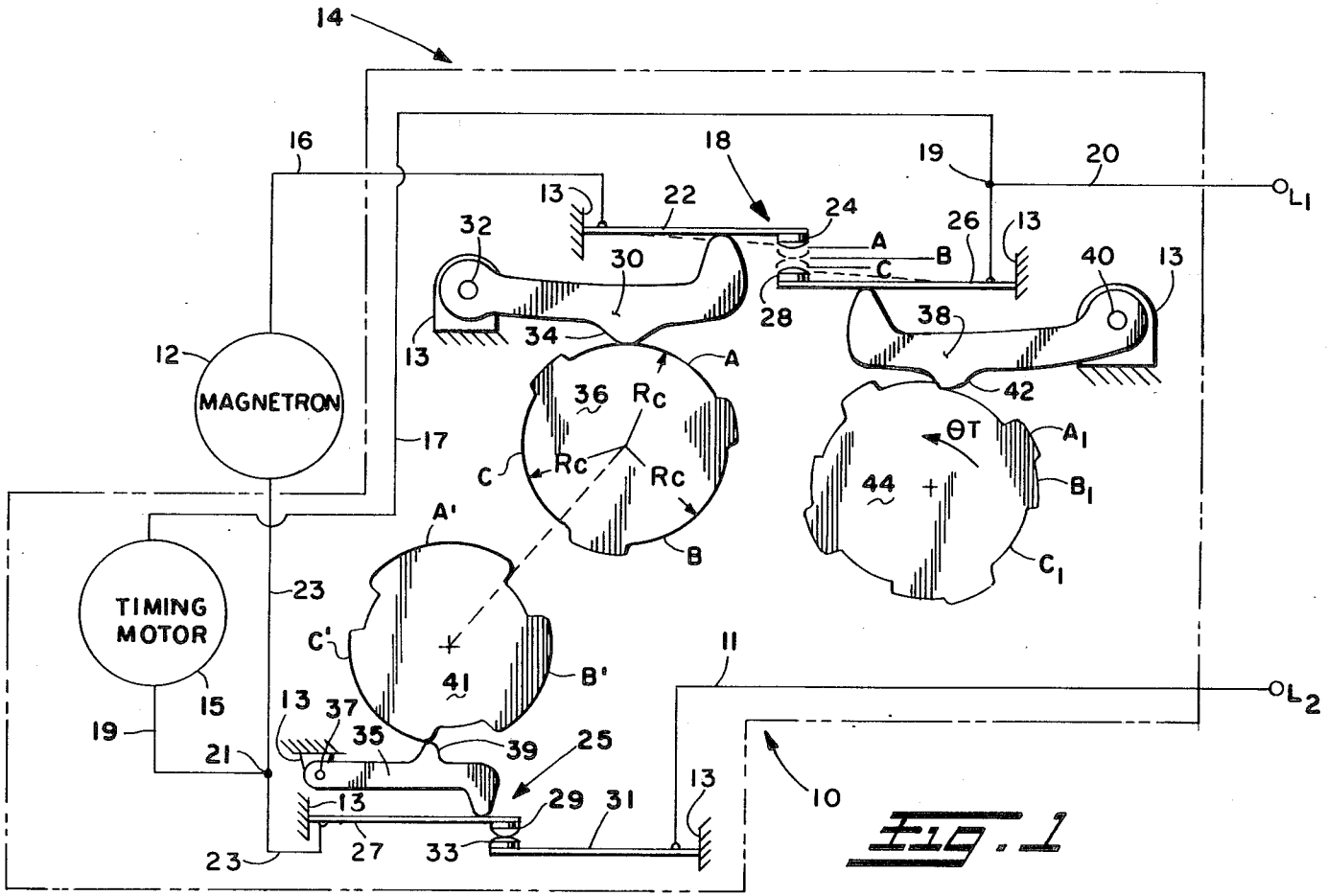
FIG. 1 is a schematic of a microwave cooking oven control system employing one embodiment the present invention.

Refering now to FIG. 1, the control system indicated generally at 10, of the present invention has an appliance load, such as microwave magnetron 12, connected to an electromechanical programmer timer 14 by lead 16 which is series connected through a switch indicated generally at 18. Switch 18 is connected through junction 19 and lead 20 to one side $L_1$ of a power line. The magnetron 12 is connected through lead 23, junction 21 and a second switch 25 and lead 11 to the opposite side $L_2$ of the power line.

Switch 18 has a first or upper contact arm 22 with one end thereof mounted to the timer base or housing 13 and is connected to lead 16 with an electrical contact 24 provided on the free end thereof. A second or lower contact arm 26 similarly has one end thereof mounted to the timer housing 13 and is connected to power lead 20 with the free end of arm 26 having an electrical contact 28 mounted thereon and disposed directly opposite of the contact 24 on the upper arm. The contact arms 22, 26 and contacts 24, 28 in FIG. 1 are shown in solid black outline in the fully open position and in dashed outline in the closed position for completing the circuit.

A cam follower arm 30 is pivotally mounted at one end thereof by a suitable pin 32 to the housing 13 and has the free end of arm 30 contacting the switch arm 22 for effecting movement thereof. The follower arm 30 has a suitable lobe 34 provided thereon intermediate the ends thereof; and, the lobe 34 contacts the surface of a main interval cam wheel 36 having interval cam lobes provided about the peripheral thereof.

The main interval cam wheel 36 is rotatably mounted on the timer housing 13 in a manner as described hereinafter with respect to FIG. 2. The interval cam 36 has the peripheral radius thereof denoted by $R_C$ in FIG. 1, varied about the periphery in a plurality of lobes denoted by the letters A, B, and C in FIG. 1.

The radius denoted $R_C$ of each of the lobes A, B, and C provides a different amount of lift or movement of the arm 30. With reference to the switch 18 in FIG. 1, the three positions of the upper contact 24 are denoted by the reference characters A, B, and C with respect to fixed reference positions on the timer housing 13 as will be hereinafter described in greater detail.

A second follower arm 38 is pivotally mounted by pin 40 at one end thereof to the timer housing 13 and has the free end thereof contacting the switch arm 26. Arm 38 has a follower lobe 42 provided intermediate the ends thereof which lobe 42 follows the surface of a sub-interval cam wheel 44 rotatably mounted on housing 13. The sub-interval cam wheel 44 has a plurality of sets, preferably four sets, of adjacent cam lobes denoted by reference characters $A_1$, $B_1$, and $C_1$ each of a different radius or lift for effecting, upon rotation of wheel 44, a different amount of movement of the follower 38 and lower electrical contact 28, for making and breaking the circuit through switch 18.

Although in the presently preferred practice the sub-interval cam wheel 44 has four sets of lift lobes for cycling switch 18 four times with each full revolution of cam wheel 44, a different number of sets may be employed to give any desired number of switch cycles per revolution.

It will be understood that with reference to the contact position denoted A, B, and C on switch 18, that the cam lobe $A_1$ on sub-interval cam wheel 44 when engaged with follower lobe 42, lifts the upper surface of the lower electrical contact 28 to the level denoted A at switch 18. Likewise, it will be understood that sub-interval cam wheel lobe $B_1$ lifts the lower electrical contact 28 to the level denoted B at switch 18; and, the cam surface denoted $C_1$ on sub-interval cam wheel 44 positions the lower contact 28 of switch 18 at the level denoted by the reference character C at switch 18.

The main interval cam 36 and the sub-interval cam wheel 44 are shown mounted separately for schematic purposes in FIG. 1; however, as will be hereinafter described more particularly with reference to FIG. 2, the programmer timer 14 has the wheels 36, 44 mounted co-axially. As will be described hereinafter, main interval cam 36 is advanced step-wise by a ratchet and pawl mechanisms; whereas, sub-interval cam wheel 44 is rotated continuously, and at a much faster rate, by a pinion and gear drive.

With continued reference to FIG. 1, one side of a timing motor 15 is connected via lead 17 to power line junction 19 and the opposite side of the timing motor is connected through lead 19 to junction 21 connected through a second switch indicated generally at 25 to the power line lead $L_2$.

Switch 25 controls operation of the timing motor and has an upper contact arm 27 with one end anchored to the housing 13 with the free end having mounted thereon a moveable electrical contact 29. A lower contact arm 31 has one end thereof mounted to the housing 13 with an electrical contact 33 mounted on the free end thereof directly opposite contact 29 for making and breaking a circuit upon movement of the contact 29. A cam follower arm 35 is pivotally mounted on housing 13 at one end thereof by a suitable pivot pin 37 and has a follower lobe 39 provided thereon intermediate the ends thereof.

A second timing cam wheel 41 is disposed adjacent interval cam wheel 36 and is rotated with interval cam wheel 36 and serves to close switch 25 when cam wheel 36 is rotated to have any of the three lobes A, B, or C in contact with the follower lobe 34. Wheel 41 has lobes A', B' and C' thereon which are similar to lobes A, B and C on wheel 36. Corresponding notches are provided on wheel 41, intermediate lobes A', B' and C' to permit the follower lobe 39 to move therein for opening switch 25 upon time-out of the program interval.

Figure 2:
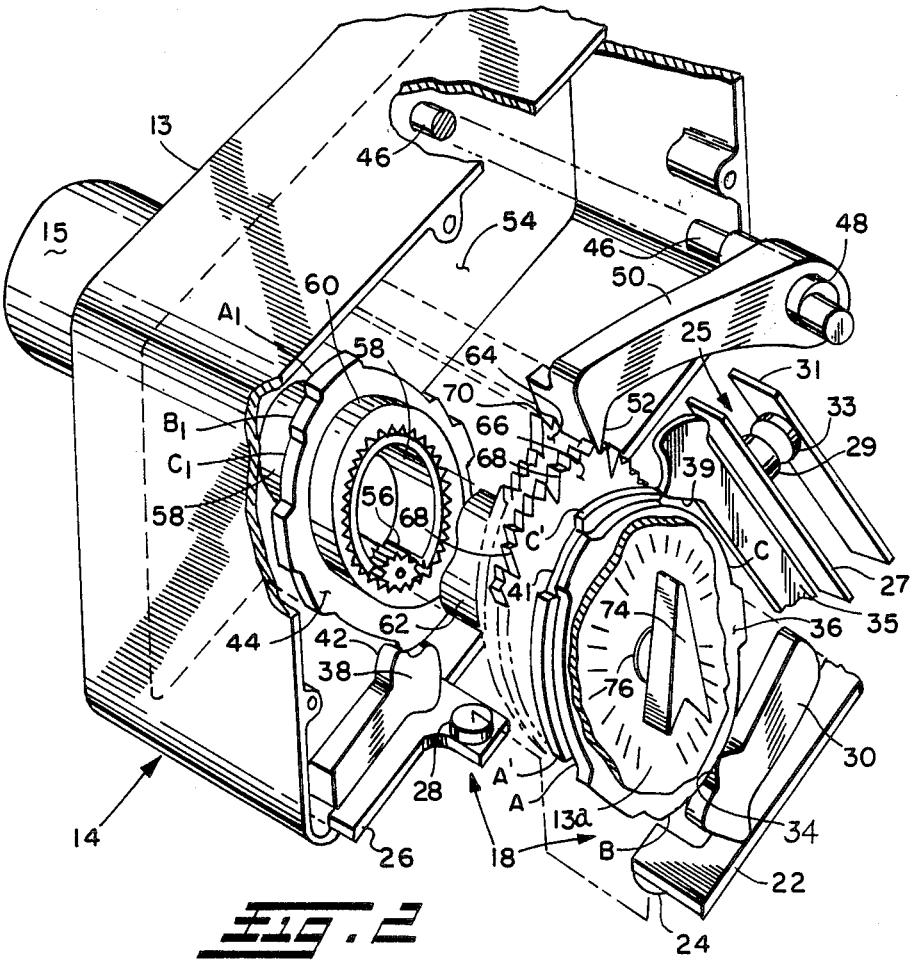
FIG. 2 is a perspective exploded view of the cam, advance and switching mechanism for the programmer-timer employed in the system of FIG. 1.

Referring to FIG. 2, programmer timer 14 has housing 13 with timing motor 15 mounted on one side thereof and connected to drive a speed reducer (not shown) disposed within the housing 13, from which a sub-interval drive shaft 46 extends on the opposite side from the motor into a cavity 54 provided in the housing 13. The sub-interval shaft 46 has mounted thereon an eccentric 48 over which is received one end of an oscillating pawl 50 which has a chisel point 52 provided on the free end thereof. It will be understood that, although the mechanism of FIG. 2 is shown in exploded arrangement, the eccentric 48 and pawl 50 and associated advance mechanisms described hereinafter are disposed within the cavity 54 which has the cover plate removed for clarity of illustration.

The housing 13 has disposed in cavity 54 a sub-interval drive pinion 56 which is operatively connected to be driven the speed reducer (not shown) located within the closed portion housing 13 on the side opposite the cavity 54. A stationary annular hub 58 is provided in cavity 54 extending from the wall thereof on the same side as the pinion and is disposed such that the annular wall thereof is interrupted to provide a space for the pinion 56 which has the teeth thereof extending beyond the outer periphery of the hub 58.

Sub-interval cam wheel 44 is attached to end preferably formed integrally with a ring gear 60 which has a plurality of teeth disposed about the inner periphery thereof. The teeth of gear 60 are received over and have their radially inner tips journalled in direct contact with the outer periphery of the hub 58 and in driving engagement with the teeth of pinion 56. In the presently preferred practice of the invention, the ratio of the teeth of pinion 56 to the number of teeth on gear 60 is chosen, in combination with the pinion rate of rotation, to give the cam wheel 44 a rate of rotation of 1 revolution per minute. This rate of rotation causes the cam follower 38 to cycle switch contact 28 through cam lobes $A_1$, $B_1$ and $C_1$ once each 15 seconds. However, it will be understood that the number and pitch of teeth on gear 58 and pinion 56 may be varied to provide any desired ratio of pinion-to-cam rotation.

The program interval switch cam wheel 36 and its companion timing motor switch cam wheel 41 are mounted in cavity 54 for rotation co-axial with sub-interval cam wheel 44. Cam wheel 36, 41 are mounted for rotation about a stationary stub shaft 62, which has a suitable cut-out (not shown) for clearing pinion 56, and which is received in and registered for alignment against the inner-periphery of stationary hub 58.

The cam wheels 36, 41 have rigidly attached thereto, for rotation therewith, a driven ratchet wheel 64 which has a plurality of teeth disposed about the periphery thereof which are engaged by the chisel point 52 on pawl 50.

In the presently preferred practice of the invention the driven ratchet 64 employs adjacent arcuate segments thereof having teeth 70, 72 of different root diameters but of common pitch. A masking ratchet wheel, denoted 66 in FIG. 2, is disposed closely adjacent driven ratchet 64 and commonly engaged by chisel point 52. The masking ratchet 66 has teeth of a common pitch with driven ratchet wheel 64.

In the presently preferred practice, 60 teeth are provided on the driven ratchet wheel giving a 6° of central arc advancement per tooth when advanced by the pawl 50.

The masking ratchet preferably employs a deep notch 68 every fifth tooth; and, the root diameter of the deep notch corresponds to the root diameter of the teeth of lesser diameter on driven ratchet 64 in the manner shown described in my U.S. Pat. No. 4,551,590 for producing a reduced rate of rotation of the wheel 64 when the teeth of lesser diameter are positioned under the chisel point 52 of the pawl 50.

Eccentric 48 on shaft 46 is preferably rotated fully each 15 seconds (4 rpm) thereby giving the ratchet wheel a 6° advance each 15 seconds when pawl 50 engages teeth 70 and 6° advance each 75 seconds when the chisel point 52 of the pawl contacts the teeth 72 of ratchet 64.

The driven wheel 64 and masking ratchet wheel 66 both have anti-reverse rotation mechanisms provided to prevent the pawl from dragging the ratchets in reverse direction on the retreat stroke of the pawl, but which mechanisms are not shown in the drawings.

Figure 3:
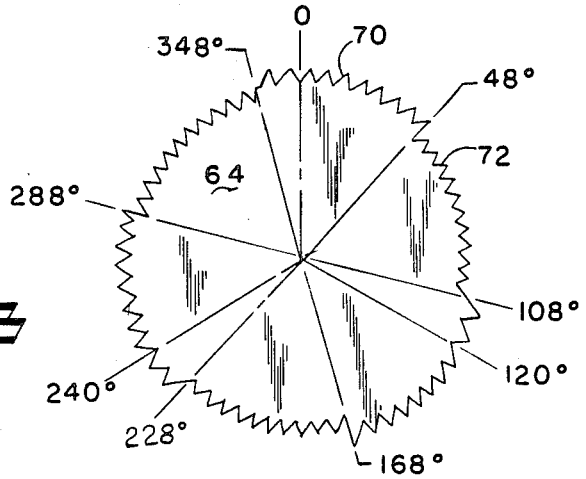
FIG. 3 is a plan view of the main interval cam advance ratchet of the mechanism of FIG. 2.

Referring to FIGS. 2 and 3, the driven ratchet wheel is shown in greater detail as having an arcuate segment of teeth 70 of the larger root diameter extending for a central arc of 60°. The teeth 72 of lesser root diameter extend for an arcuate distance subtending a central angle of 60° and are adjacent the arcuate segment of teeth 70. The teeth 70 and 72 are arranged circumferentially coincident with the lobes A, B and C on the cam wheel 36. The arrangement of the driven ratchet shown in FIG. 3 thus permits an expanded scale for the terminal portion of the range of timing intervals for each of the cam lobes A, B and C on wheel 36.

A knob 74 is provided on a shaft 76 extending from wheel 36 through housing cover plate **13*a* only a portion of which is shown in FIG. 2. The knob 74 is operative upon user rotation, to a selected interval time position to rotate the wheel 36 with respect to the cam follower lobe 34 for causing actuation of switch 18. A plurality of markings for the three time interval scales are provided on the outer surface of the cover plate 13*a***.

Figure 4:
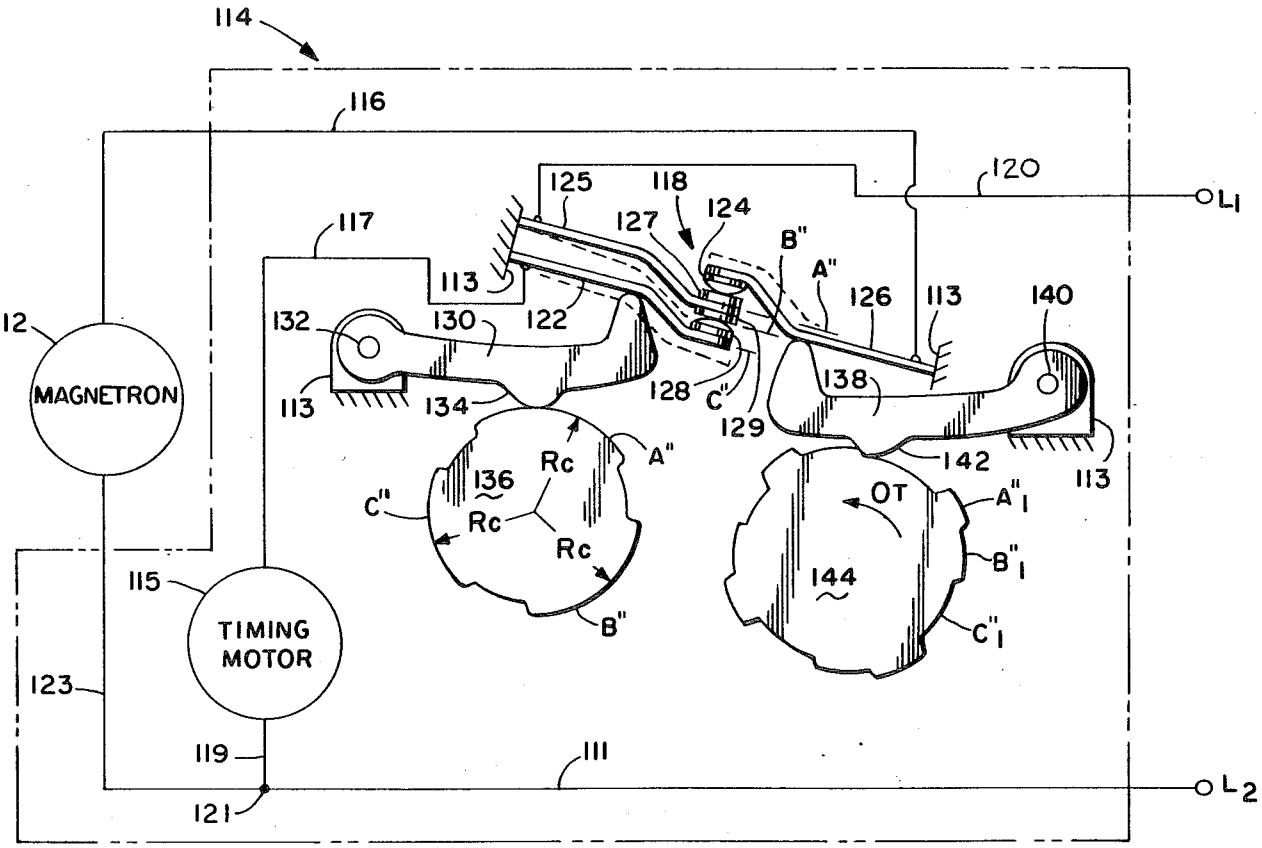
FIG. 4 is an enlarged detail of the control knob and a portion of the dial plate of the mechanism of FIG. 2.

Referring to FIG. 4 the interval time range scales for each of the three power levels of operation are shown in enlarged detail wherein each of the scales has the terminal portion of the selected interval marked in a time scale of zero to two minutes. The zero-two minute portion of each scale thus comprises an expanded scale with respect to the remaining portion of the scale which is marked for intervals in the range 2 through 12 minutes. It will be understood however, that the interval range may be greater or less than the 12 minutes illustrated in FIG. 4, the choice depending upon the desired maximum cooking interval to be provided.

Referring to FIGS. 1 and 2, the timing motor switch 25 is shown with its cam follower 35 and lobe 39 contacting the lobe C′ of wheel 41 for controlling operation of the timing motor. When the ratchet wheel 64 has been indexed by pawl 50 to the appropriate point for time-out of the magnetron operating interval, the cam follower lobe 39 drops into one of the notches between lobes A′, B′ and C′ on wheel 41 opening switch 25, and the timing motor is cut-off. Simultaneously therewith, power to the magnetron is cut off by the high lobes, intermediate the power level selecting lobes A, B and C on wheel 36 lifting lobe 34 and follower 30 to open switch 18.

In the presently preferred practice of the invention, the driven ratchet wheel 64 has a portion of each of the arcuate segments of the teeth 72 subtending a central angle of 12°, e.g. two of the teeth 72, disposed circumferentially coincident with the high lobes on cam wheel 36 to provide advancement of these lobes to cam follower 34, and the notches in cam wheel 41 to the follower 39, to effect simultaneously opening of switch 18 for cut-off of the magnetron and opening of switch 25 for cut-off of the power to the timing motor.

Although the advance mechanism for the program interval cam wheel 36 has been described herein above with reference to a dual rate of advance ratchet wheel 64 in combination with a masking ratchet 66, it will be understood that a single rate of advance mechanism may be utilized by employing teeth of a common root diameter about the entire circumference of the driven ratchet 64 and by eliminating the masking ratchet 66. Utilizing only a single rate of advance would however eliminate the expanded portion of the time interval scales which would then appear linear rather than expanded as shown in FIG. 4.

Referring now to FIGS. 5, 6 and 7 the timing of the operation of switch 18 for cycling of the magnetron during a selected program interval is illustrated graphically as a simplified plot of the load current $I_L$, neglecting rise times and surges, versus rotational position, indicated by the reference character $\theta_T$ in degrees, of sub-interval cam wheel 44. The timing is plotted individually for each of the cam lobes having the radius thereof $R_c=A$, $R_c=B$ and $R_C=C$ respectively and the corresponding positions of the upper contact 24 of the switch 18 as selected by rotating the knob 74 to the selected power level interval scale on the dial to thereby select one of the cam levels A, B or C on wheel 36.

Referring to FIG. 5, the duty cycle of the magnetron current is plotted as a function of $\theta_T$ for one complete revolution of sub-interval cam 44 for the condition that power level cam surface $R_c=A$ has been chosen for cam wheel 36. It will be seen from the graph in FIG. 5 that the sub-interval cam 44 is then effective, upon rotation, to close the contacts 24, 28 of switch 18 only when sub-interval cam lobe $A_1$ raises follower arm 38 to cause the upper switch contact 24 to be in position A. When contact 24 is in position A, only sub-interval cam $A_1$ has sufficient lift to close switch 18. In the power level range selected to use cam surface A on cam 36 the sub-interval cam lobe $A_1$ produces the lowest fraction duty cycle for the magnetron. In the presently preferred practice of the invention, the width of the cam lobe $A_1$ on sub-interval cam wheel 44 is chosen to give a duty cycle in the range of 20% to 33% which has been found to be satisfactory for low level "WARM" or "DEFROST" modes of operation for the microwave oven.

Referring now to FIG. 6, the magnetron duty cycle is plotted for the power level selection wherein cam surface $R_c=B$ of cam wheel 36 is positioned to cause cam follower 30 to lift the upper switch contact 24 of switch 18 to the corresponding level denoted B in FIG. 1. With the switch contact 24 pre-positioned to the B level, sub-interval cam lobes $A_1$ and $B_1$ are both effective to lift and maintain the cam follower 38 lifted to cause contact 28, thereby closing switch 18 for a time duration representative of the accumulated width of cam lobes $A_1$ and $B_1$. The combined accumulated period of closure of switch 18 has effected by cam lobes $A_1$ and $B_1$ thus comprises a greater fractional duty cycle for ON-time of the magnetron as shown in FIG. 6.

Referring now to FIG. 7, the magnetron ON-time is shown as a result of selecting cam surface $R_c=C$ of cam wheel 36 to lift the cam follower 30 for prepositioning the upper contact 24 of switch 18 to position C. With the switch contact 24 in the lowest position as shown by the reference character C in FIG. 1, all three of the cam lobes, $A_1$, $B_1$ and $C_1$ on sub-interval cam wheel 44 are effective to raise cam follower 38 and switch contact 28 to cause switch 18 to close and remain closed for the entire period of rotation of the sub-interval wheel 44. Thus, selection of cam surface $R_c=C$ on the interval cam 36 provides the maximum power level or continuous magnetron operation for the full duration of the selected cooking interval.

Referring now to FIG. 8, an alternate embodiment of the invention is shown wherein the programmer timer 114 has the magnetron 12 series, connected through lead 116 and through a triple contact switch, indicated generally at 118, and lead 120 to one side $L_1$ of the power line. The other side of the magnetron is connected via lead 123 to a power junction 121 connected through lead 111 to the opposite side $L_2$ of the power line.

The switch 118 has an upper contact arm 126 anchored at one end to the housing 113 of the programmer 114 with the free end of arm 126 having a contact 124; and, contact arm 126 is connected to magnetron lead 116.

Switch 118 has a lower contact arm 122 anchored to housing 113 at one end thereof with a lower switch contact 128 mounted on the free end thereof and directly opposite upper contact 124. The lower contact arm 122 is connected via lead 117 to a timing motor 115 which has the other side thereof connected via lead 119 to power line junction 121.

Switch 118 also has an intermediate contact arm 125 with one end thereof anchored to housing 113 and the free end thereof having provided thereon an upper contact 127, disposed opposite contact 124, and a lower contact 129 disposed opposite contact 128. The contact arm 125 is connected as a common terminal to power line lead 120.

The programmer timer 114 has a speed reducer and cam advance mechanism similar to that of FIG. 2; and, for simplicity the description thereof will be omitted with respect to the embodiment of FIG. 8. In the FIG. 8 embodiment, a main interval cam wheel 136 is provided having cam lobes with radius $R_c$ and denoted A", B" and C", respectively and the cam wheel is advanced by an indexing ratchet wheel and pawl in the manner shown in FIG. 2. The FIG. 8 embodiment also has a sub-interval cam wheel 144 continuously driven in the manner described with respect to the FIG. 2 embodiment. The embodiment of FIG. 8 eliminates the need for a separate switch to control the timing motor and thus eliminates the second cam track and follower for the main interval cam, these functions being combined in the operation of switch 118 as will hereinafter be described.

Cam follower 130 has a lobe 134 thereon for contacting the surface of cam wheel 136 and the follower 130 is pivotally attached to the housing 113 by a suitable pivot pin 132. When the main interval cam 136 is rotated by the user to cause the cam track C" thereon to lift cam follower 130, the contact 128 is pre-positioned to the position indicated in dashed outline in FIG. 8 and denoted by reference character C".

The contact 128 is thus positioned for the lowest power level duty cycle by cam track C".

A second cam follower 138 pivotally attached to the housing 113 by a suitable pin 140 through the end of the arm 138 disposes the arm such that a suitable lobe 142 provided on the follower arm contacts sub-interval cam 144 at its periphery. With the contact 128 in the position as determined by cam track C", contact 128 closes against contact 129 to complete the circuit to energize the timing motor to begin operation of the programmer timer and effect rotation of sub-interval cam wheel 144. When the main interval cam wheel 136 is positioned to utilize cam track C″, only sub-interval cam track $C_1''$ is operative to permit the upper contact 124 to contact intermediate contact 127 to complete the circuit to the magnetron. This results in the lowest fraction duty cycle for the magnetron as determined by the width of cam track $C_1''$.

If the user rotates cam wheel 126 to cause cam track B″ to raise the cam follower 130, contact 128 is raised to the level B″ shown in FIG. 8 which also closes against contact 129 to close the circuit to energize the timing motor. With contact 128 pre-positioned according the lift of cam track B″, the upper contact 124 is permitted to close against contact 127 for providing current flow to the magnetron when the follower lobe 142 is in contact with both sub-interval cam track $B_1''$ and $C_1''$ thereby providing a greater fractional duty cycle to the magnetron.

In the FIG. 8 embodiment, user rotation of interval cam wheel 136 to a position causing cam track A″ to lift follower lobe 134, the lower contact 128 is pre-positioned in its uppermost position denoted by A″ in FIG. 8, which closes contact 128 and 129 to energize the timing motor causing rotation of sub-interval cam wheel 144. With the contact 128 in its uppermost operating position as determined by cam track A″, the upper contact 124 of switch 118 is caused to contact the central contact 127 when the cam follower 142 is in contact with all of the cam tracks $A_1''$, $B_1''$, and $C_1''$ thereby resulting in continuous ON-time for the magnetron and thus the highest level power for cooking.

Main interval cam wheel 136 has provided thereon a suitable notch between each of the cam tracks A″, B″ and C″ which notches subtend a central arc of 12° similar to the raised high lobes on cam wheel 136. The notches in the main interval cam 136 permit the cam follower arm 130 to drop to its level upon time out from any of the cam tracks A″, B″ or C″ to cause the switch contact 128 to drop thereby simultaneously breaking the circuit to contacts 129 and 124 for cutting off the timing motor and magnetron. It will be understood that in all other respects, the embodiment of FIG. 8 is similar to the embodiment of FIG. 2.

The present invention thus provides a unique and novel programmer timer for an electrical appliance such as a microwave cooking oven, in which rotation by the user of a single control knob to a selected program position on one of three dial plate scales permits selection of the mode of operation or power level and program interval duration. The present invention provides a timing mechanism driven by a single timing motor for actuating a plurality of switch contacts for effecting control of the plural levels of operational mode and selection of program time interval. Optionally the single timing motor driven mechanism provides a dual rate of advance for providing an expanded portion of the scale for selecting program interval.

Although the invention has herein above been described with respect to the illustrated embodiments, it will be understood that the invention is capable of modification and variation and is limited only by the scope of the following claims.

What is claimed:

1. A programmable control system for an electrically energized appliance comprising:

(a) load means operable upon connection to a power line to perform a predetermined function;

(b) switch means series connected with said load means and operable upon actuation to connect said load means to said power line for electrical current flow thereto and operable upon deactuation to disconnect said load means from said power line, said switch means having a pair of electrical contacts each mounted on a moveable blade means and having:

(i) interval cam means including follower means contacting said switch means and knob means operable upon appliance user selection of one of a first second and third rotary positions of said knob means to move one of said moveable switch blades to one of a first, second and third predetermined positions for a selecting power level for load means operation and said selection of said cam means position also operable to include selection of the time duration of said interval for programming said load means;

(d) a timing motor and speed reducer means;

(e) cam advance means connected to said speed reducer means operable to advance said cam means at a pre-determined rate for time out of said selected interval;

(f) sub-interval cam means operable upon cyclic advance to move the other of said moveable blade means through a first, second and third positions for effecting cyclic actuation of said pair of contacts;

(g) sub-interval advance means connected to said speed reducer means and operable to cyclically advance said sub-interval cam means at a certain multiple of the rate of said cam advance means;

(h) said one blade means in said first position operable to provide a first fractional duty cycle for said load means during said selected program interval, said one blade means in said second position operable to provide a second fractional duty cycle substantially greater than said first fraction for said load means during said selected program interval, and said one blade means in said third position operable to provide 100% duty cycle, or full "ON", for said load means during said selected program interval.

2. The control system defined in claim 1, wherein said advance means comprises a ratchet wheel driven by a cyclically advanced pawl.

3. The control system defined in claim 1, wherein said cam advance means provides a first rate of advance for an initial portion of said selected interval greater than a certain duration followed by a second slower rate of advance for the terminal portion of said interval and said cam advance means provides only said second slower rate of advance for selected intervals less than said certain duration.

4. The control system defined in claim 1, wherein selection of said first position of said one moveable switch blade operates with the first position of said other moveable switch blade for effecting cyclic actuation of said switch means to provide 20% duty cycle for said load means.

5. The control system defined in claim 1, wherein selection of said second position of said one moveable switch blade cooperates with said first and second positions of said other moveable switch blade for effecting cyclic actuation of said switch means to provide a 40% duty cycle for said load means.

6. The control system defined in claim 1, wherein said advance means comprises a ratchet wheel engaged by a pawl and an eccentric means operable for oscillating said pawl for advancing said ratchet wheel, wherein said ratchet wheel has a first portion of its circumference provided with teeth of a first root diameter and a second portion of the circumference adjacent thereto provided with teeth of a substantially lesser root diameter, said advance means including masking ratchet means operable to prevent said pawl from engaging said teeth of said second portion for a predetermined number of successive oscillations of said pawl to provide a slower rate of advance when said pawl engages said teeth of said second portion.

7. A programmer-timer for an electrical appliance comprising:

(a) housing means;

(b) a single timing motor and speed reducer means mounted on said housing means;

(c) switch means mounted on said housing means adapted for series electrical connection to an appliance to be controlled, said switch means having a first moveable blade member with a first electrical contact thereon and a second moveable blade member with a second electrical contact thereon, said blade members moveable to make and break said first and second electrical contacts for controlling power to said appliance;

(d) selector knob means operable upon rotation by the appliance user to, (i) a first position to select the desired program interval of appliance operation and a first functional mode of operation, (ii) a second position to select the desired program interval of appliance operation and a second functional mode of operation, (iii) a third position to select the desired program interval of appliance operation and a third functional mode of appliance operation;

(e) program interval cam means operatively connected for rotation with said selector knob, said program cam means operable, (i) in said first control knob means position to move said first contact arm to a first position;

(ii) in said second control knob means position to move said first contact arm to a second position;

(iii) in said third control knob means position to move said first contact arm to a third position, said cam means operable upon advancement from said selected position to control the program interval of operation of said appliance;

(f) cam advance means connected to said speed reducer means and operative to rotate said cam from said first, second or third position, for time-out of said selected program interval, said program cam means operable upon advancement from said selected position to time said appliance program interval;

(g) sub-interval cam means connected to said speed reducer means for cyclic operation;

(h) sub-interval advance means operable for periodically advancing said sub-interval cam means at a period comprising a minor fraction of said program interval for duty-cyclic actuation and deactuation of said switch means at sub-intervals of said program interval, said sub-interval cam means operable, to move said second contact arm for actuating said switch means for a first fraction of said sub-interval period when said first contact arm is in said first position and to move said second contact arm for actuating said switch means for a second fraction of said sub-interval period when said first contact arm is in said second position and to move said second contact arm for maintaining said switch means actuated for the entire sub-interval period when said first contact arm is in said third position.

8. The programmer-timer defined in claim 7, wherein said first, second and third positions of said selector knob means each comprise a position on a separate interval range scale comprising a separate arc of rotation of said selector knob means.

9. The programmer-timer defined in claim 7, wherein said sub-interval cam means includes a cam wheel rotating at a rate of one revolution per minute.

10. The programmer-timer defined in claim 7, wherein said sub-interval cam means has a cyclic period of fifteen seconds.

11. The programmer-timer defined in claim 7, wherein said interval cam advance means comprises a toothed driven ratchet wheel and a toothed masking ratchet wheel engaged and driven by an oscillating drive pawl connected to said speed reducer means.

12. The programmer-timer defined in claim 7, wherein:

(a) said speed reducer includes an output pinion gear;

(b) sub-interval cam means includes a ring gear having teeth disposed about the inner periphery thereof and engaging said pinion gear; and, (c) said housing means includes a stationary annular hub extending therefrom adjacent said pinion gear with said hub having the radially inner points of said ring gear teeth journalled for rotation directly on the outer periphery of said hub.

13. The programmer controller defined in claim 7, wherein:

(a) said speed reducer has an output shaft extending therefrom with an eccentric thereon; and, (b) said interval cam means includes a ratchet wheel and drive pawl with said pawl having one end thereof received over said eccentric for effecting oscillatory movement thereof in response to rotation of said eccentric.

14. A programmer-timer for an electrically energized appliance comprising:

(a) housing means;

(b) a timing motor and speed reducer means mounted on said housing means;

(c) switch means mounted on said housing means, said switch means adapted for series connection to the appliance load, said switch means having a first moveable contact member and a second moveable contact member said first and second contact members moveable for effecting making and breaking of a circuit for the appliance load function;

(d) interval cam means including a selector member operable upon user movement, (i) to a first range of positions of selected program intervals to move said first contact member to a first duty cycle position and to position said interval cam means for a desired program interval, (ii) to a second range of positions of selected program intervals to move said first contact member to a second duty cycle position and to position said interval cam means for a desired program interval, (iii) to a third range of positions of selected program intervals to move said first contact member to a third duty cycle position and to position said interval cam means for a desired program interval;

(e) program interval cam advance means connected to said speed reducer means and operable to effect timed advance of said interval cam means from said user selected position to time out said selected program interval; and, (f) sub-interval cam means operative upon cyclic advancement to move said second contact member for making and breaking a circuit with said first contact member, said sub-interval cam means operative, upon said cyclic advancement, (i) when said first contact is in said first duty cycle position to effect a first predetermined fractional duty-cycle for contact of said second contact member with said first contact member, (ii) when said first contact is in said second duty cycle position to effect a second predetermined fractional duty-cycle for contact of said second contact member with said first contact member, (iii) when said first contact is in said third duty cycle position to effect a 100% duty cycle (full "ON") for contact of said second contact member with said first contact member; and, said interval cam means operative upon said time out advancement to prevent contact of said second contact member with said first contact member until said interval cam means is moved by the user.

15. The programmer-timer defined in claim 14, wherein said program interval cam means and said sub-interval cam means comprise first and second cam rings co-axially mounted on said housing means for individual advancement.

16. The programmer-timer defined in claim 14, wherein said housing means includes a stationary annular hub extending therefrom; and, said program interval cam includes a ring gear having a plurality of teeth formed about the inner periphery thereof, with the tips of said teeth journalled for rotation in direct contact with the outer periphery of said hub.

17. The programmer-timer defined in claim 14, wherein said program interval cam advance means includes a driven ratchet wheel attached to said program cam means for effecting rotation thereof and a masking ratchet rotatable with respect to said ratchet wheel and an advance pawl connected to said speed reducer means for oscillatory movement for effecting advancement of said ratchets, said masking ratchet having deep notches thereon at spaced multiples of the peripheral teeth for effecting reduced rate of advancement of said program interval cam means when said program cam means is advanced to certain predetermined positions thereon.

18. The programmer-timer defined in claim 14, wherein said sub-interval cam means effects cyclic movement of said second contact member every fifteen seconds.

19. The programmer-timer defined in claim 14, wherein said sub-interval cam means causes said second contact member to make a circuit with said first contact member for 20% of said duty cycle of said sub-interval cam means.

20. The programmer-timer described in claim 14, wherein said first position of said first contact member effects a $\frac{1}{3}$ fractional duty cycle for appliance operation and said second position of said first contact member effects a $\frac{2}{3}$ fractional duty cycle for appliance operation.

21. A programmer timer for controlling an electrically energized appliance comprising (a) housing means;

(b) speed reducer means mounted on said housing means;

(c) a timing motor mounted on said housing means and motor connected to drive said speed reducer means;

(d) a main interval cam mounted for rotational advancement on said housing means;

(e) means for effecting timed advancement of said main interval cam, said advancement means including a ratchet wheel and advance pawl contacting said ratchet wheel, said advance pawl operatively connected to said speed reducer means for oscillatory movement for advancing said ratchet wheel;

(f) a journalling surface on said housing means;

(g) sub-interval cam means including a ring gear having teeth provided on the inner periphery thereof, said teeth showing the points thereof journalled directly on said journalling surface;

(h) pinion means engaging said ring gear teeth and operatively connected to said speed reducer for driving said ring gear, and, (i) switch means;

(j) cam follower means responsive to said sub-interval cam means and operative to actuate and de-actuate said switch means in response to advancement of said sub-interval cam means.

22. A programmer-timer for controlling an electrically energized appliance comprising:

(a) housing means having a timing motor mounted thereon;

(b) speed reducer means mounted on said housing means and connected to said motor means, said speed reducer means having an output shaft rotating at a predetermined rate;

(c) electrical switch means mounted on said housing means and operative upon actuation and deactuation to make and break a circuit for controlling the appliance;

(d) cam means rotatably mounted on said housing means;

(e) advance means responsive to said output shaft rotation operative to move said cam means in timed advance, said advance means including an internally-toothed ring gear and driving pinion engaging said internal teeth;

(f) stationary hub means provided on said housing means and defining a bearing surface thereon, said surface having said internally toothed ring gear received thereover with said teeth journalled for rotation directly on said bearing surface.

* * * * *